United States Patent [19]

Ghibely

[11] Patent Number: 4,676,423

[45] Date of Patent: Jun. 30, 1987

[54] DRIVE-IN APPARATUS FOR SEVERAL DRIVE-IN BLOWS

[75] Inventor: Bruno Ghibely, Ahrensburg, Fed. Rep. of Germany

[73] Assignee: Demba Metallwarenfabrik GmbH, Bargteheide, Fed. Rep. of Germany

[21] Appl. No.: 784,361

[22] Filed: Oct. 4, 1985

[30] Foreign Application Priority Data

Oct. 10, 1984 [DE] Fed. Rep. of Germany ... 8429756[U]

[51] Int. Cl.[4] ..... B25C 5/02; B25C 7/00

[52] U.S. Cl. ..... 227/121; 227/120; 227/130

[58] Field of Search ..... 227/120, 121, 130, 131

[56] References Cited

U.S. PATENT DOCUMENTS 3,012,247 12/1961 Sillars et al. ..... 227/121
4,500,025 2/1985 Skwor ..... 227/121

FOREIGN PATENT DOCUMENTS 3304302 8/1984 Fed. Rep. of Germany ..... 227/131
3320251 12/1984 Fed. Rep. of Germany ..... 227/131
681733 10/1952 United Kingdom ..... 227/121

*Primary Examiner*—Paul A. Bell

*Attorney, Agent, or Firm*—Kinney & Lange

[57] ABSTRACT

Drive-in apparatus for fastening means such as staples, nails, etc., especially electro-tacker, comprising a housing having a powered driving plunger supported therein which is connected to a drive-in plunger at the lower end thereof, a tool section arranged at the bottom portion of the housing which contains a drive-in channel with the drive-in plunger guided therein, a magazine for the fastening means in which the fastening means are advanced by means of a spring-biased feeder in the direction of the drive-in channel, and a means cooperating with the respective foremost fastening means which prevents further fastening means being seized by the drive-in plunger upon one or several drive-in blows of the drive-in plunger following a first drive-in blow, with a movable stop (34, 52) supported in the housing (10, 40) which is actuable by an outward projecting movable actuation member (28, 46) and which, in the working position, limits the return stroke of the driving plunger (15, 43) in such a manner that the drive-in plunger (18, 44) prevents the entrance of a further fastening means into the drive-in channel and, in the position of release permits a full return stroke of the driving plunger (15, 43).

8 Claims, 3 Drawing Figures

DRIVE-IN APPARATUS FOR SEVERAL DRIVE-IN BLOWS

The invention relates to a drive-in apparatus for fastening means such as staples, nails etc., especially electro-tackers, comprising a housing having a power-driven driving plunger mounted therein which is connected at the lower end thereof to a drive-in plunger, a tool section arranged at the lower portion of the housing and containing a drive-in channel having the drive-in plunger supported therein, a magazine for the fastening means in which the fastening means are advanced in the direction of the drive-in channel by a spring-biased feeder, and a device cooperating with the respectively foremost fastening means said device preventing in case of one or several drive-in blows of the drive-in plunger following the first drive-in blow, further staples being seized by the drive-in plunger.

Such a device is known (German utility model No. 83 13 386). It comprises an adjustable resetting member which, when in the normal position has a cam arranged in a recess of the tool section on the side of the drive-in channel opposite to the magazine and which, upon adjustment against the feeding direction of the fastening means in the magazine is moved in such an extent that the respectively foremost staple comes to lie outside the drive-in channel. In this position the drive-in plunger may perform as many blows as may be desired and, thus, may be used as a striking tool, in order to drive in particularly long fastening means, for example, into a hard or solid workpiece. With the aid of such a device it is also possible to use apparatus dimensioned to be smaller in output for driving in relatively long fasteners and fastening means, respectively, into very hard workpieces. The design which is smaller in terms of output, reduces the weight of the drive-in apparatus. Furthermore, the repulsion strokes are naturally smaller and no longer make themselves felt by the operator so disturbingly. With the known apparatus, however, always before the driving-in of a new fastening means, the resetting member must be adjusted into the starting position. Thereby, the speed at which the fastening means may be processed one after the other is limited.

It is the object of the invention to provide a drive-in apparatus for fastening means, the drive-in plunger of which may be employed also as a striking tool through manipulations compatible with practical operation.

This object is attained in accordance with the invention in that a movable stop is mounted in the housing which is adapted to be actuated by an outward projecting actuating member and which, when in the working position, limits the return stroke of the driving plunger in such a manner that the drive-in plunger prevents the entrance of any further fastening means into the drive-in channel and which, when in the position of release, allows a full return stroke of the drive-in plunger.

The designation "driving plunger" comprises that portion of the drive-in apparatus which is connected to the drive-in plunger and upon which a force is exerted.

This force may be a pneumatic compression pressure, for example. In that case the driving plunger is designed in the form of a piston. It may, however, also be a portion of a magneto armature which, in case of release, is pulled into a magnet coil, in order to actuate the drive-in plunger.

Upon actuation of the stop via the movable actuation member the driving plunger is indeed in a position to perform its first working stroke so that the drive-in plunger may transport a fastening element out of the drive-in channel and drive it into a workpiece, the path of the drive-in plunger upon return storke being limited by the stop. This limitation is such that the drive-in plunger projects into the drive-in channel a sufficient distance such that the next fastening element cannot arrive in the drive-in channel. If, now, one or several further drive-in blows are initiated, the drive-in plunger is effective as a striking tool. No fastening means are driven out in this operation. The drive-in plunger, indeed, no longer has the maximum length of working stroke available, but it normally suffices to generate a sufficient striking force. With electronically controlled electric drive-in apparatuses, above all, the striking force per stroke may be replaced by the number of striking strokes. This number may be programmed in the electronic control, for example. In this manner it is possible to have a desired number of strokes follow each first drive-in stroke by which a fastening means is driven out, said number of following strokes then being adapted to drive the fastening means completely into the workpiece. With the aid of an electronic control it is possible in this operation also to obtain a high frequency of strokes which is by far higher than could be obtained with manual operation of the trigger.

In one embodiment of the invention provision is made for the stop to be biased into the position of release by a spring. By simply loosening the actuation member, thus, the condition may be brought about in which a new fastening means is driven out. According to another embodiment of the invention the stop preferably cooperates with the upper end of the driving plunger which, when designed in the manner of a magneto armature, may comprise an enlargement at the upper end thereof for cooperation with the stop. It goes without saying that the driving plunger may also be provided with a lateral extension for cooperation with the stop.

In a particularly advantageous embodiment of the invention provision is made for the stop to comprise a spring-biased rotatably supported latch, which is adapted to be overrun during the first working stroke of the driving plunger but, in the opposite direction, offers a resistance to intercept the driving plunger. If the actuating member is supported in such a manner that with the gripping portions of the drive-in apparatus being seized it is operated automatically, a fastening means may nevertheless be driven out of the drive-in channel with the first working stroke. The driving plunger overruns the stop and upon its return stroke seizes the opposite side of the stop, so that the return stroke is correspondingly limited. So as to avoid a hard impact against the stop upon return stroke, provision is made in another embodiment of the invention for the resistance to be provided by a strong spring. If the actuation member is released, the spring-biased actuation member and the spring-biased latch, respectively, pivots the latter out of the path of stroke of the driving plunger so that with a renewed release of the drive-in apparatus, another fastening means may be shot.

There are various possibilities of designing and fitting an actuation lever for the movable stop. The usual drive-in apparatuses comprise a transversely extending handle portion which is seized by hand from above, with a release pressure key situated on the underside of the gripping portion. For such an embodiment provision is made in a further development of the invention for the stop to be operable by a lever which is pivotally supported at the upper surface of the handle portion of the housing. The lever is pressed automatically downward upon the gripping portion being seized so that the stop is moved into the working position. As already described, the stop does not become effective on the driving plunger during the first working stroke but only during the return stroke thereof, in order to limit it in an upward direction.

Instead of fitting the lever above the gripping portion, a lever or a pressure key may also be fitted, for example, on the upright housing portion projecting upward above the gripping portion and having the driving plunger supported therein.

In an alternative embodiment provision is made for the stop to be fixedly connected to the spring-biased actuation member and adapted to be actuated by pressure from the upper surface of the housing. The actuation member may be a lever supported pivotally or floatingly at the upper surface of the housing and having the stop connected thereto preferably by being formed integrally therewith, against which the upper end of the driving plunger comes to lie in close contact in the dead center position. If, now, the actuation member is pressed downward by hand, the return stroke of the driving plunger is automatically limited. The forces created in this operation may readily be intercepted by hand, as has been shown.

As already explained, pressure keys are used in many cases as release means which are pressed into the gripping portion in order to release the drive-in apparatus. In this connection, provision is made in one embodiment of the invention for the retention means for the pressure key to be supported movably in the gripping portion and to be coupled with the actuation member in such a manner that only upon actuation of the actuation member into the working position will the pressure key project from the handle portion so much that the actuation thereof will be effective to cause an operation of release. With this embodiment, a safety feature is at the same time obtained. In the non-operated condition of the actuation lever the driving plunger cannot be released. If, however, the actuation member is actuated, the drive-in apparatus may indeed be released, however, only one single fastening means is driven out, while all the following drive-in blows cannot entail any danger in case they should be directed against the body of the operator. If the drive-in apparatus is in addition equipped with a known-per-se safety means against blind shots, complete safety in operation free from danger will be provided. The safety means against blind shots mostly consist of a sensor projecting from a workpiece which, upon contact with the workpiece is moved upwards and only thereby releases the drive-in channel. In the other case a release of the drive-in apparatus results in the drive-in plunger knocking against a stop in the drive-in channel, thus being unable to drive out a fastening means.

The invention will be described in the following in more detail by way of drawings.

Figure 1:
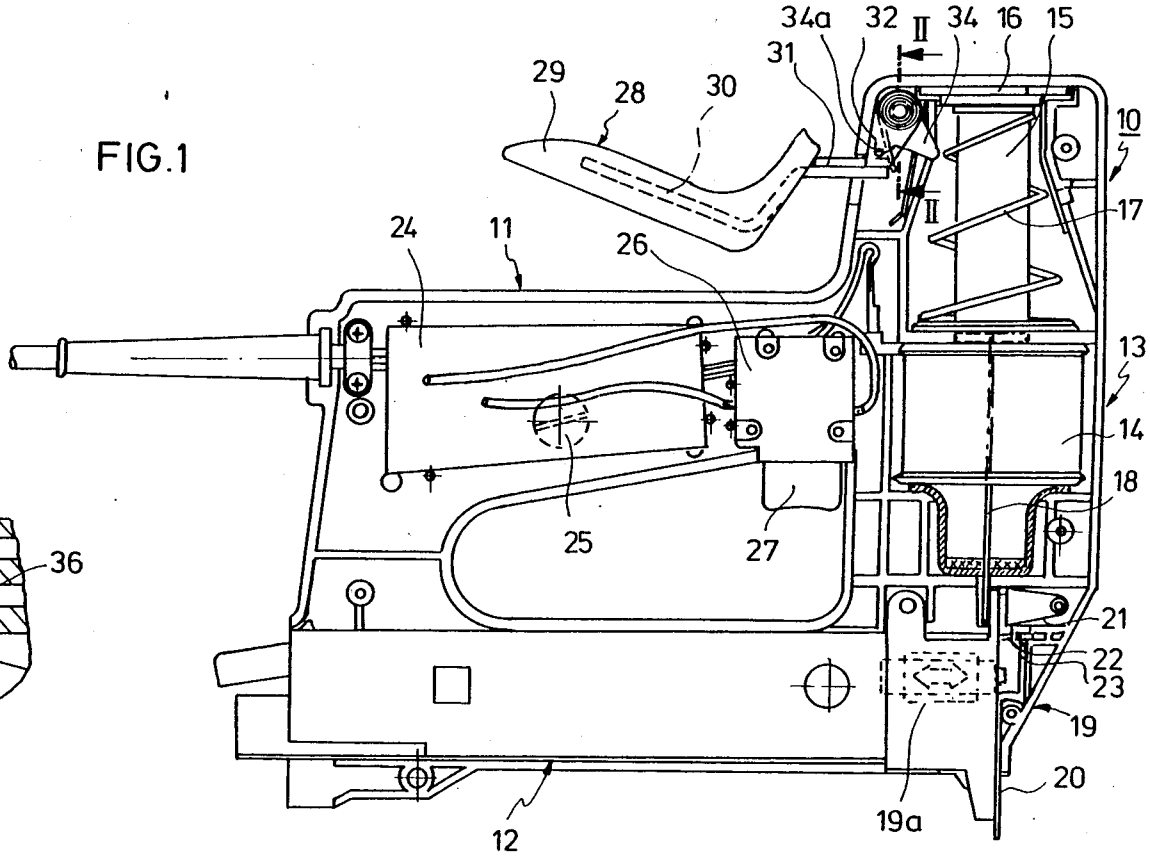
FIG. 1 shows a sectional view of a first embodiment of the drive-in apparatus according to the invention.

Prior to enlarging in more detail on the individual representations shown in the drawings, it has to be stated that each of the features described by itself or in connection with the features of the claims is of inventively essential importance.

FIG. 1 shows a so-called electro-tacker comprising a housing 10 with a gripping portion 11, a magazine 12 and a drive-in portion 13. Arranged in the latter is a magnet coil 14 cooperating with a cylindrical armature 15 which is provided with a flange 16 at the upper end. Disposed in the flange 16 is the upper end of a return spring 17 the lower end of which is supported at a housing wall. The armature 15 which may also be designated as driving plunger, is connected at its lower end to a drive-in plunger 18. Arranged in the lower region of the housing portion 13 is a tool section 19 which contains, inter alia, a drive-in channel with the drive-in plunger 18 guided therein. In the magazine 12 U-staples, for example, are advanced with the aid of a feeder (not shown) in the direction of the drive-in channel, so that the respective foremost U-staple is seized by the drive-in plunger when the apparatus is actuated. Arranged in parallel with the drive-in channel is a safety element to be capable of displacement. Said safety element cooperates at its upper end with a helical spring 21. The safety element 20 which projects downwards above the orifice of the drive-in channel, extends through a barrier element 22 which is supported to be capable of movement normal to the drive-in channel. In the position as shown in FIG. 1 the barrier element 22 is disposed in a position spaced through a short distance below the lower end of the drive-in plunger 18, so that upon actuation of the apparatus the drive-in plunger 18 will knock against the barrier element and thus will be unable to drive out a U-staple. If, however, the safety element 20 is moved upward by being fitted on a workpiece, an oblique portion 23 of the safety element 20 will push the barrier element 22 away from the drive-in channel so that the latter will now be free.

On the side of the tool portion 19 shown opposite in FIG. 1 a pusher **19*a* is arranged having a portion thereof projecting into the tool section. This portion may grip the foremost U-staple and upon actuation of the pusher may force the entire bar of staples back against the spring power of the feeder so that both the said portion and the foremost staple come to lie outside the shooting line. The drive-in plunger 18** may then be employed as a real striking apparatus.

Figure 2:
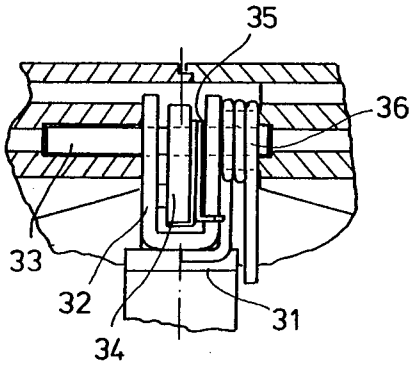
FIGS. 2 shows a sectional view taken along line 2—2 of FIG. 1.

Arranged in the gripping portion 10 is an electronic control 24 by means of which, inter alia, via a control button 25 the striking energy may be adjusted. Furthermore arranged in the gripping portion 11 is a switch 26 which is adapted to be actuated by means of a downward pointing pressure key 27. Extending above the gripping portion 11 is an angular actuating lever 28 which consists of a gripping member 29 of synthetic material with inlaid metallic portion 30. A protruding portion 31 projects from the latter above a corresponding opening into the housing portion 13; it is connected to a fork 32 which is pivotally supported in the housing portion 13 by means of a bearing pin 33 (see also FIG. 2). Pivotally supported between the fork arms is a latch 34. A first helical spring 35 is effective between the latch 34 and the fork 32 which adjusts the two members with respect to each other into the position as shown in FIG. 1. With the lever 28 not actuated the latch 34 in this arrangement points obliquely downwards so that the driving plunger 15 upon actuation has the broadest portion 16 thereof moving freely past the latch 34. A second helical spring 36 is effective between the fork 32 and the housing portion 13 attempting respectively to urge the actuating lever 28 into the position shown in FIG. 1. The relative position of fork 32 and latch 34 in the direction of pressure of the spring 35 is limited by a stop which is formed by a portion of the member 31 against which a section 34*a* of the latch 34 comes to lie in close contact.

The drive-in apparatus shown operates as follows:

When the operator seizes the apparatus by the gripping portion, he automatically also presses the lever 28 in a downward direction. Owing thereto, the latch 34 pivots anticlockwise as far as beneath the flange 16. If, now, the pressure key 27 is actuated, the armature 15 will move downward, and the drive-in plunger 18 will drive a fastening means through the drive-in channel into the workpiece (not shown), if the safety element 20 is adjusted upwards in the manner as described above. With the downward movement of the armature 15 the flange 16 comes to lie against the latch 34. However, the latter is capable of clockwise pivotal movement with only the counteracting energy of spring 35 having to be overcome. The latter, however, is designed to be relatively weak. As soon as the flange 16 has moved past latch 34, the latter will pivot back counterclockwise into the end position according to FIG. 1. During the return stroke, thus, the flange 16 hits against the underside of the latch 34. As the latter cannot be pivoted further counterclockwise and the actuating lever 28 lies in close contact against the gripping portion 11, the return stroke is limited in an upward direction. Owing thereto, the drive-in plunger 18 remains in the drive-in channel to such an extent that a further fastening means cannot be advanced thereafter into the drive-in channel. If, now, the pressure key 27 is actuated anew, the drive-in plunger 18 may be utilized as a striking plunger as often as may be desired as long as the actuating lever 28 remains depressed. The safety element 20 keeps further in the elevated position in the manner as described above because the barrier slide 22, too, cannot return to the position of blocking.

It is also easily possible to design the electronic control 24 in such a manner that with each operation of driving-in a preset number of blows may be performed, with the first blow respectively serving to shoot out a fastening means, while the subsequent drive-in blows are deploying a hammering effect, in order to completely drive the fastening means into the workpiece.

Figure 3:
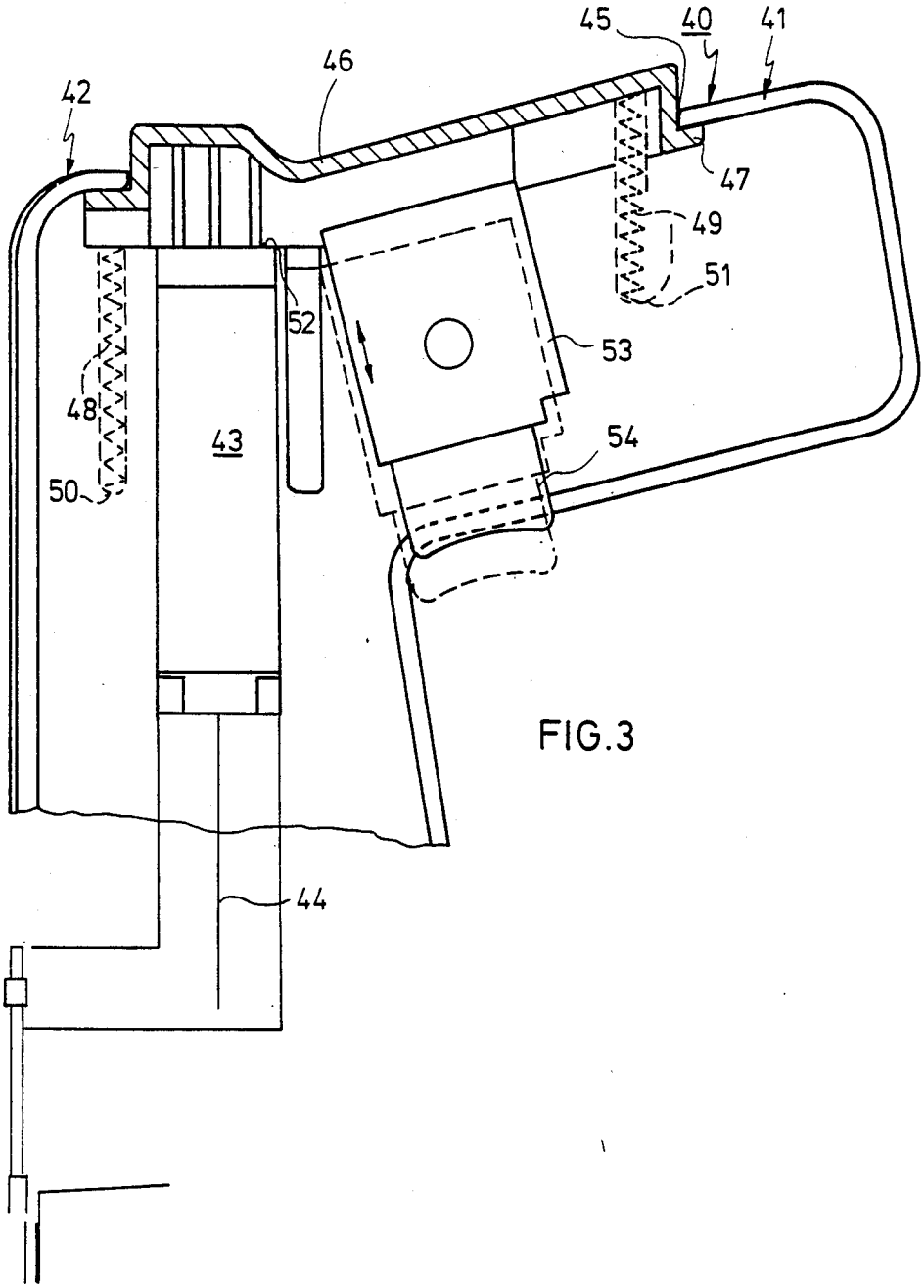
FIG. 3 shows in a strongly diagrammatic view a second embodiment of the drive-in apparatus according to the invention.

The drive-in apparatus shown in FIG. 3 is represented in an extremely diagrammatic manner. Magazine and tool section are completely omitted. The housing 40 is distinguished for the feature that the gripping portion 41 adjoins the upper end of the housing portion 42 comprising the tool section, said gripping portion forming with the housing portion 42 an obtuse angle. Placed in the housing portion 42 is a driving plunger 43 such as an armature for an electrotacker, for example. The driving plunger 43 is connected to a drive-in plunger 44 at the lower end thereof. The coil for the armature 43 is not shown.

On the upper surface of the gripping portion 41 an elongated opening 45 is provided which is filled out by a correspondingly shaped elongated actuation element 46. The actuation element 46 is provided on the circumference thereof with an outward pointing marginal flange 47 engaging beneath the underside of the upper wall of the gripping portion 41. Springs 48, 49 shown in broken lines cooperate with the underside of the actuation element 46 and are supported at 50 and 51, respectively, in the housing. They thus urge the actuation element 46 into the position shown in FIG. 3.

In its forward region the actuation element 46 has a downward pointing abutment surface 52 against which the upper surface of the drive-in plunger 43 comes to lie in close contact. If, through actuation of the actuation element 46 by pressure from above the latter is pressed downward, the abutment surface 52, too, will move downward, thus limiting the path of the return stroke of the driving plunger 43. Owing thereto, as already described above, the drive-in plunger 44 may remain in a position level with the bar of staples in the drive-in channel, in order to prevent the entrance of another fastening means into the drive-in channel.

The floatingly supported actuation element 46 cooperates with a switching block 53 movably supported in the gripping portion 41 which is provided with a pressure key 54 at the lower end thereof. In the position shown in FIG. 3 the switching block 53 is disposed in the upper position, so that the pressure key 54 projects but slightly downward out of the gripping portion 41. If the pressure key is actuated, the path of adjustment does not suffice to release the drive-in apparatus (the energy supply and control, respectively, are omitted from FIG. 3 for reasons of simplicity). If, however, by seizing the gripping portion 41 the actuation element 46 is pressed downward, the switching block 53, too, will move downward into the broken line position. Now, an actuation of the pressure key 54 may also be effective to cause release of the drive-in apparatus. In this manner, because of the possibility of employing the drive-in plunger 41 as a striking plunger, a safety feature is also provided. An inadvertent actuation of the pressure key 54 with the gripping portion 41 not properly gripped, thus, cannot be effective to cause release of the drive-in apparatus.

In comparison with the embodiment according to FIG. 1 the mode of operation with the last-described one is different insofar as the fastening means is separated from the magazinised bar already upon depression of the element 46 and is moved downward a small distance in the drive-in channel. Besides, it will be noted that the return stroke of the armature 43 substantially is intercepted by hand. Finally, mention should still be made of the fact that the apparatus shown is equally suited for right-handed and left-handed operators.

I claim:

1. Apparatus for driving fastening means of the type having a housing having a power-driven driving plunger mounted therein which is connected to a drive-in plunger at the lower end thereof, a tool section arranged at the bottom portion of the housing which contains a drive-in channel with the drive-in plunger guided therein, a magazine for the fastening means in which the fastening means are advanced in the direction towards the drive-in channel by means of a spring-biased feeder, and a device for preventing, in case of one or several drive-in blows of the drive-in plunger following a first drive-in blow, further fastening means being engaged by the drive-in plunger, the improvement wherein said device for preventing comprises a movable stop (34, 52) supported in the housing (10, 40) and an outward projecting movable actuation member (28, 46), the movable stop being set in a working position on actuation of the actuation member to limit the return stroke of the drive-in plunger (15, 43) in such a manner that the drive-in plunger (18, 44) prevents the entrance of a further fastening means into the drive-in channel and is reset to a release position on deactivation of the actuation member to permit a full return stroke of the driving plunger (15, 43).

2. Apparatus according to claim 1, characterized in that the stop (34) is biased into the release position by a spring (36).

3. Apparatus according to claim 1 characterized in that the stop (36) cooperates with the upper end (16) of the drive-in plunger (15).

4. Apparatus according to claim 1, characterized in that the stop (34) comprises a spring-biased, rotatably supported latch which is adapted to be overrun during the first working stroke of the drive-in plunger (15), however, in the opposite direction of rotation offers a resistance to intercept the drive-in plunger (15).

5. Apparatus according to claim 1, characterized in that an abutment (34) is adapted to be actuated by a lever (28) which is pivotally supported at the upper surface of the gripping portion (11).

6. Apparatus according to claim 1, characterized in that the stop (52) is rigidly connected to a spring-biased actuation member (46) and is adapted to be actuated by pressure from the upper surface of the housing.

7. Apparatus according to claim 6, characterized in that an elongated actuation member (46) is floatingly supported in the housing (40, 41).

8. Apparatus according to claim 6, wherein a pressure key (54) is arranged on the release means, characterized in that a retension block (53) for the pressure key (54) is movably supported in the gripping portion (41) and is coupled to the actuation member (46) in such a manner that only upon actuation of the actuation member (46) into the working position the pressure key (54) will move out of the gripping portion (41) so far that adjustment thereof is effective to cause a releasing operation.

* * * * *